US012195258B2

(12) United States Patent
Guerin et al.

(10) Patent No.: US 12,195,258 B2
(45) Date of Patent: Jan. 14, 2025

(54) TAMPER-EVIDENT POUCH CLOSURE

(71) Applicant: OBRIST CLOSURES SWITZERLAND, Reinach (CH)

(72) Inventors: Fabrice Guerin, Shanghai (CN); Jack Chang, Shanghai (CN); Frederic Chave, Saint-Georges-de-Reneins (FR); Jerome Mezerette, Saint-Georges-de-Reneins (FR)

(73) Assignee: OBRIST CLOSURES SWITZERLAND GMBH, Reinach (CH)

( * ) Notice: Subject to any disclaimer, the term of this patent is extended or adjusted under 35 U.S.C. 154(b) by 173 days.

(21) Appl. No.: 17/763,738

(22) PCT Filed: Oct. 1, 2020

(86) PCT No.: PCT/EP2020/077610
§ 371 (c)(1),
(2) Date: Mar. 25, 2022

(87) PCT Pub. No.: WO2021/064154
PCT Pub. Date: Apr. 8, 2021

(65) Prior Publication Data

US 2022/0332488 A1 Oct. 20, 2022

(30) Foreign Application Priority Data

Oct. 1, 2019 (GB) ..... 1914131
Jun. 10, 2020 (GB) ..... 2008810

(51) Int. Cl.
*B65D 75/58* (2006.01)
*B65D 55/16* (2006.01)

(52) U.S. Cl.
CPC ..... *B65D 75/5883* (2013.01); *B65D 55/16* (2013.01); *B65D 2401/60* (2020.05)

(58) Field of Classification Search
CPC .... B65D 41/48; B65D 41/3428; B65D 41/32; B65D 41/34; B65D 55/16; B65D 75/5883;
(Continued)

(56) References Cited

U.S. PATENT DOCUMENTS 6,273,307 B1 * 8/2001 Gross ..... B65D 75/5883 220/613
2004/0238564 A1 12/2004 Bourque
(Continued)

FOREIGN PATENT DOCUMENTS

CN 101309839 A 11/2008
KR 20020075761 10/2002
(Continued)

OTHER PUBLICATIONS

International (PCT) Search Report and Written Opinion for PCT/EP2020/077610 dated Feb. 8, 2021, 10 pages.
(Continued)

*Primary Examiner* — Robert J Hicks
(74) *Attorney, Agent, or Firm* — Barnes & Thornburg LLP

(57) ABSTRACT

A pouch fitment is provided and comprises a base which is attachable to a pouch and includes a dispensing spout. The fitment further comprises a closure cap for closing the spout. The closure cap is non-releasably associated with the base. The base and the closure cap are connected by a hinge. The fitment comprises a tamper-evident member. The tamper-evident member is movable from an engaged position to a released position. In the engaged position the closure cap is blocked from opening and in the released position the closure cap can be opened.

15 Claims, 12 Drawing Sheets

Figure 2:
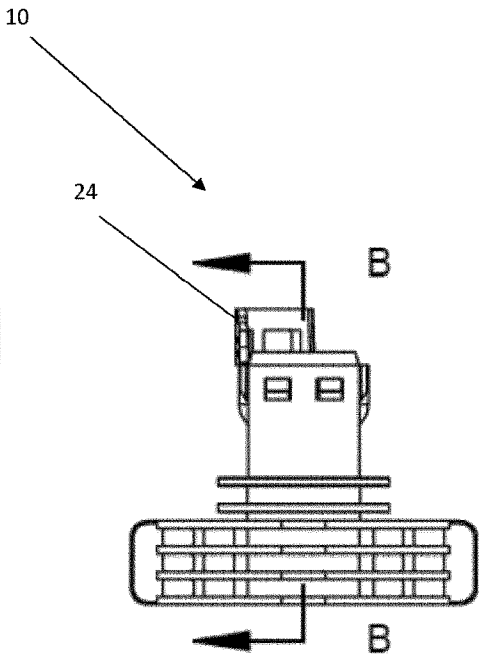
Figure 2:
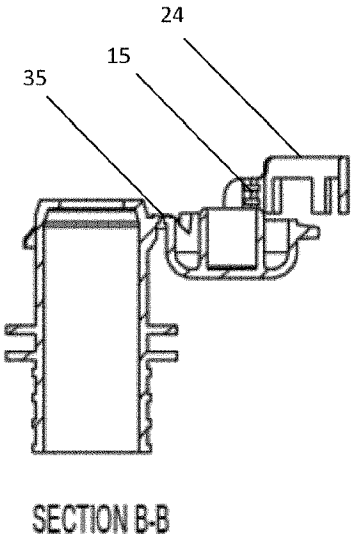

(58) Field of Classification Search
CPC ..... B65D 75/5872; B65D 75/5861; B65D 75/58; B65D 2401/60
USPC ..... 215/254, 253, 250, 243, 237, 235, 306; 220/837, 836, 810, 266, 265; 222/541.6, 222/541.1, 568, 567
See application file for complete search history.

(56) References Cited

U.S. PATENT DOCUMENTS

| | | | | |
|---|---|---|---|---|
| 2017/0107008 | A1 | 4/2017 | Ichikawa | |
| 2019/0177044 | A1 | 6/2019 | Beringer | |
| 2022/0250816 | A1* | 8/2022 | Tamarindo ..... | B65D 41/3447 |

FOREIGN PATENT DOCUMENTS

| | | | |
|---|---|---|---|
| KR | 20020075761 | A | 10/2002 |
| KR | 101937657 | | 1/2019 |

OTHER PUBLICATIONS

International Search Report and Written Opinion for PCT/EP2020/077610 dated Feb. 8, 2021.
Chinese Office Action for Chinese Appl. No. 202080069166.2 mailed Jun. 30, 2023, counterpart to U.S. Appl. No. 17/763,738, No English Translation Availabile, 9 pages.

* cited by examiner

TAMPER-EVIDENT POUCH CLOSURE

CROSS REFERENCE TO RELATED APPLICATIONS

This application is a U.S. national stage application under 35 U.S.C. § 371 (b) of International Application No. PCT/EP2020/077610, filed Oct. 1, 2020, which claims priority to the United Kingdom Patent Application No. 1914131.6, filed on Oct. 1, 2019 and United Kingdom Patent Application No. 2008810.0, filed Jun. 10, 2020, the disclosures of each of which are hereby expressly incorporated by reference in their entirety.

The present invention relates generally to pouches and particularly, although not exclusively, to dispensing fitments, closures and the like for collapsible pouches intended to contain liquid or semi-liquid product.

Collapsible or squeeze pouches are used for containing a wide variety of products including food, beverages, personal care and household care, which may be in the form of a liquid, lotion, gel, paste or the like. Such pouches are typically made from a flexible heat-sealable polymeric sheet or from a flexible, paper boiled or metal foil sheet having a heat-sealable, polymeric lining. The pouch has two opposed flexible sheets which are peripherally sealed to each other so as to define an interior chamber for containing product and to define an opening between the interior and the exterior of the pouch. The opening receives a dispensing fitment, such as a plastic spout, for example with a base defining a dispensing passage and a removable cover for opening or closing the dispensing passage. The fitment is often secured in the opening between the flexible pouch sheets, for example, by heat sealing or adhesion.

The present invention seeks to provide improvements in or relating to pouches, pouch fitments and combinations thereof.

An aspect of the present invention provides a pouch fitment comprising a base which is attachable to a pouch and includes a dispensing spout, the fitment further comprises a closure for closing the spout, in which the closure is non-releasably associated with the base.

In some embodiments the closure may be formed integrally with the base, for example by moulding (e.g. mono- or bi-injection moulding). The fitment may, for example, be formed in an open position and then moved to an initially closed position (e.g. using im-mould closing, or by a post moulding operation).

In some embodiments the closure may be formed separately from the base and may be assemblable therewith.

The closure may, for example, be hingedly attached to the spout, for example by a film hinge, snap hinge, butterfly hinge or the like.

The fitment may comprise tamper-evident means for showing that the closure has been opened at least once.

Some embodiments provide a fitment comprising a non-detachable tamper-evident member.

Some embodiments provide a spout for pouch with a non-detachable tamper-evident band.

A tamper-evident member may be movable from an engaged position to a released position. In some embodiments, in the engaged position the closure cannot be opened and in the released position the closure can be opened.

The tamper-evident member may be hinged to the closure for movement from an engaged ("locked") to a released ("unlocked") position.

The closure may be attached to the base by a tether, for example a "lasso" type tether.

In some embodiments a tethered closure cap may be provided, such as a tamper-evident tethered closure.

Arranged on the lower edge of the cap wall of the closure cap may be a retaining ring that engages beneath a bead on fitment when the closure cap is in position. On opening the container, only an upper cap portion is removed, while the lower retaining ring remains firmly connected to the fitment.

A tether may connect the retaining ring with the cap wall so that the cap will remain connected with the fitment (and hence with the pouch) and cannot be mislaid or discarded separately. The retaining ring is simultaneously used as an anti-tamper ring for the display of initial opening of the container. To this end, the retaining ring may, for example, connected by means of frangible bridges with the lower edge of the cap wall. The retaining ring can slide over a bead on the fitment (for example on the spout) on initial fitting of the closure cap without risk to the bridges; and the ring subsequently holds securely on the container mouth.

The retaining ring of such a closure cap may have one or more tongues/flaps protruding radially inwardly on its inside surface, said tongues extending towards the cap base and engaging beneath the bead on the container mouth when the closure cap is in position on the container mouth. The tongue/s are connected only at one end with the retaining ring, and their free end is able to pivot in a radial direction. On initial fitting of the closure cap, the tongue/s can therefore be pivoted outwards in the radial direction when they slide over the bead onto the spout.

The present invention provides a closure for a pouch fitment, comprising a cap and a retaining ring for retaining the closure on a fitment, a tether is provided between the cap side wall and the retaining ring along the circumference of the cap, one end of the tether is fixedly connected to the side wall and the other end is fixedly connected to the retaining ring, in which the tether is connected to the cap by a root.

The tether may extend from the root in a clockwise direction.

The tether may extend from the root in an anti-clockwise direction.

The closure may comprise a main line of weakness/frangible line formed between the cap and the ring.

In some embodiments a tether-forming frangible line is formed axially beneath the main frangible line.

There may be two (axial) levels of bridge break during opening. The tether may be formed below main frangible line. The tether may be formed above main frangible line. Main and tether-forming frangible lines may be substantially parallel.

The interface between the main frangible line and the tether-forming frangible line may be chicane-like or generally L-shape.

Fitments formed in accordance with the present invention may comprise one or more frangible bridges.

Fitments formed in accordance with the present invention may comprise one or more non-frangible bridges.

The present invention also provides a fitment as described herein in combination with a pouch.

The pouch may comprise a generally rectangular bag-like structure.

The pouch may, for example, be formed from a front sheet and a rear sheet which may be made from polymeric sheets, or metal foil sheets having heat-sealable polymeric linings.

The sheets may be heat-sealed together at their peripheries to form a seam. The seam may extend around the periphery of the sheets except for along the top edge where an opening is formed. The opening may receive the fitment, which may also be heat sealed to the two sheets either side of the opening.

The present invention also provides, in combination, a flexible pouch and a fitment, the fitment includes a base and a closure, the closure remains linked to the base after opening.

The fitment may be formed from a material and the pouch may be formed from the same material.

The fitment may be formed as a unitary component.

The closure may be formed as a unitary component.

Some aspects and embodiments of the present invention relate generally to a closure and particularly, although not exclusively, to a tethered pouch closure.

The present invention also provides a closure as described herein in combination with a base (which may together for a pouch dispensing fitment).

The present invention also relates to closures and/or bases as described herein in combination with a (flexible) pouch.

In some embodiments a tamper-evident band is moulded with a lid.

There may be a hinge function between the lid and the tamper-evident band.

There may be no hinge function between the lid and the tamper-evident band.

In some embodiments the link with the tamper-evident band is not breakable; only the bridges need to be broken to allow the lid to be open.

Before the first opening, hooks may maintain the lid closed in position with the tamper-evident band and the bridges not broken.

The present invention also provides a spout for pouch with a non-detachable tamper-evident band.

Some aspects and embodiments relate to a tamper-evident single component for a flexible pouch which should remain linked to the base after opening.

The concept may use a hinge between a cover and a base.

Tamper-proofness may consist of at least one detachable element with clip linked to the cover by bridges.

When closing the cover detachable element with clip may snap into a housing of the base to create inviolability.

The cover may be snapped onto a rim.

When the cover/hood is opened by a consumer there may be a rupture of bridges which creates an opening indicator and the detachable element remains fixed to the base.

The tilting of the cover around the hinge area, this fact at the time of opening and frees the drinker.

In some embodiments the cover is still attached to the base after opening by means of the hinge.

During the reclosing of the hood the hinge may resume its initial place allowing the snap-fitting of the hood on the contents and thus guarantee the tightness.

Some embodiments consist of a single component; therefore it is manufactured with a single material. If the pouch is made from the same material as the one-component, there is a 100% recyclable system.

In another embodiment the clip can be on the tie-back and the housing is located in the detachable element of the cover A further embodiment relates to a tamper-evident cap for flexible pouch which should remain attached to the pouch after opening; proposal of an innovative connection solution.

The concept uses a strap between a plug and a base.

When the strap belongs to the plug, the base being welded to the pouch, the deformation of the strap during unscrewing and re-screwing is complicated: crushing or twisting of the strap hampering use.

In some embodiments a strap belongs to a tie.

When the plug is screwed onto the tie-back the belt of the plug snaps into the clip of the strap.

The clip is free in the clearance of the cap, which allows the rotation of the plug for complete screwing.

When the cap is unscrewed, the connection, between the cap and the cap, comes to jam against the clip.

By continuing to divide the strap takes place, the bridges break, which creates an opening indicator; but the plug remains attached to the tie.

By removing the plug to release the rim, the strap deforms but the plug is still held by the clip therefore the plug remains attached to the receptacle.

When the strap is screwed back on, it will return to its original position, allowing the plug to be screwed back onto the tie-back.

A further embodiment relates to a tamper-evident cap for flexible pouch which should remain attached to the base after opening; proposal of an innovative connection solution.

The embodiment uses a hinge between the cap and the tamper-evident belt.

The cap is snapped at the level of the inviolability band, on the collar.

When the plug is opened, the bridges break, which creates an opening indicator. The tilting of the plug a, around the hinge zone causes the strands to extend, which allows the plug to be released beyond the rim. This movement can be facilitated by the presence of a rigid element and protruding from the main body, a tongue, which, bearing on the neck, serves as a point of rotation.

The tab remaining in contact with the neck of the base allows the plug to be kept in the open position.

The plug being connected by strands to the tamper-evident belt in the open position, the plug is always attached to the base after opening.

When closing, the strands will resume their initial places allowing the closure and snap-on of the cap on the collar.

A further embodiment relates to a tamper-evident cap for a flexible bag which should remain attached to the base after opening; proposal of an innovative linking solution.

A strand connects cap of cap to the strip inviolability, this strand is completely part of the design of the cap.

The embodiment has a base, a stopper body and its tamper-evident band as a basic element common to different versions.

When screwing the cap on the base, the tamper-evident band snaps onto the counter ring of the base, the tamper-evident band remains free to rotate.

When the cover is unscrewed, the bridges break, which creates an opening indicator.

By moving the cover aside to release the drink, the strand is deformed but the cover is still attached to the tamper-evident band.

When screwing in, the tamper-evident strip and the strand rotate with the cover.

Option to block cover in the open position on the base.

The lug of the base allows the hole created on the strand to snap onto it.

A further aspect provides a tethered pack for pouch packaging.

Different aspects and embodiments of the invention may be used separately or together.

The present invention is more particularly described, by way of example, with reference to the accompanying drawings.

The example embodiments are described in sufficient detail to enable those of ordinary skill in the art to embody and implement the systems and processes herein described. It is important to understand that embodiments can be provided in many alternate forms and should not be construed as limited to the examples set forth herein.

Accordingly, while embodiment can be modified in various ways and take on various alternative forms, specific embodiments thereof are shown in the (drawings?) and described in detail below as examples. There is no intent to limit to the particular forms disclosed. On the contrary, all modifications, equivalents, and alternatives falling within the scope of the appended claims should be included.

Unless otherwise defined, all terms (including technical and scientific terms) used herein are to be interpreted as is customary in the art. It will be further understood that terms in common usage should also be interpreted as is customary in the relevant art and not in an idealized or overly formal sense unless expressly so defined herein.

In the following description, all orientational terms, such as upper, lower, radially and axially, are used in relation to the drawings and should not be interpreted as limiting on the invention.

FIGS. 1 to 11

FIGS. 1 to 11 illustrate a pouch fitment generally indicated 10.

The fitment 10 comprises a base 12 and a closure cap 14. The base 12 and the cap 14 are connected by a hinge 35.

The closure cap 14 comprises a circular top plate 16 with a side wall 18 depending from the periphery thereof.

The base 12 comprises a spout 20 and a sealing part 40.

The sealing part 40 comprises two lateral/axial tabs 42, 44 joined by four (in this embodiment) horizontal fins 46. Axial strengthening members 48 extend between the fins 46.

A frontal tamper-evident member 24 (in this embodiment being a band/strip) is moulded with the cap. A hinge function/mechanism 15 (such as a material thinning and/or other formations) is provided between the cap 14 and the band.

The link between the cap and the band is not breakable; only bridges 26 need to be broken to allow the cap to be opened.

Figure 3:
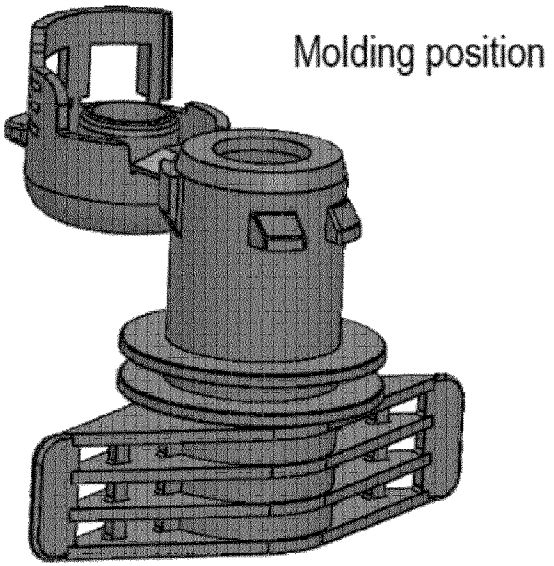
Figure 4:
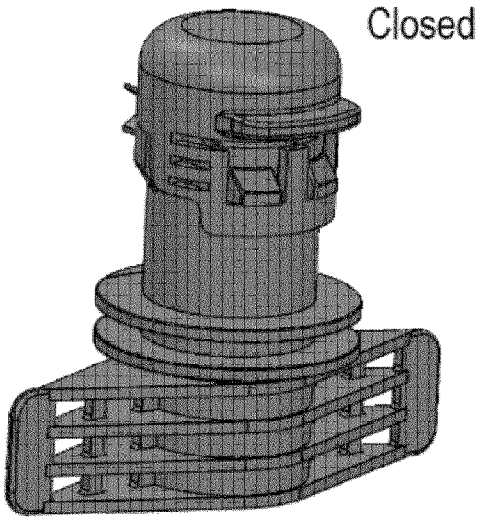
Figure 5:
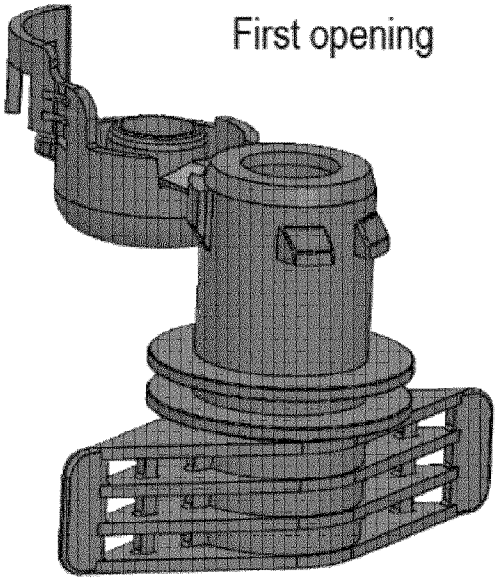
Figure 6:
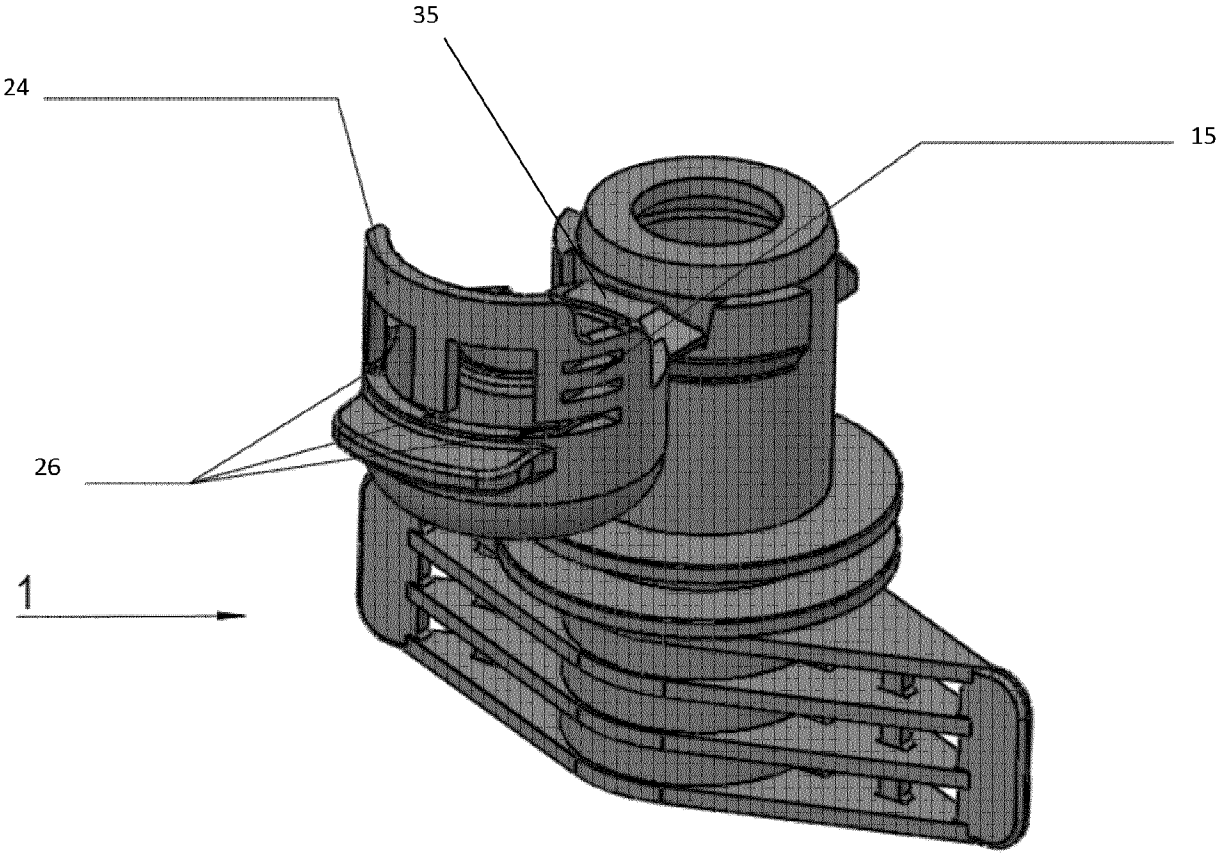
Figure 7:
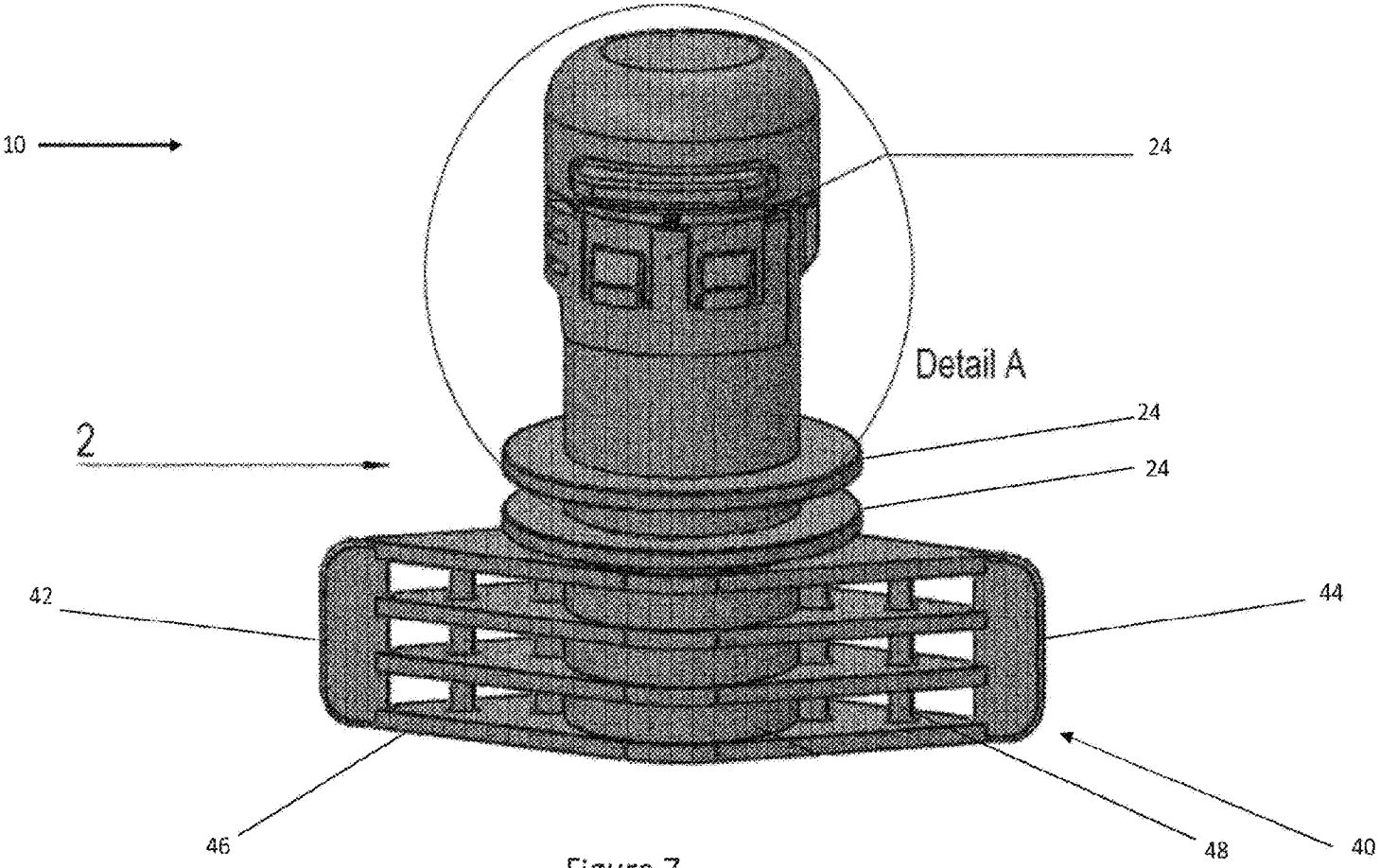
Figure 8:
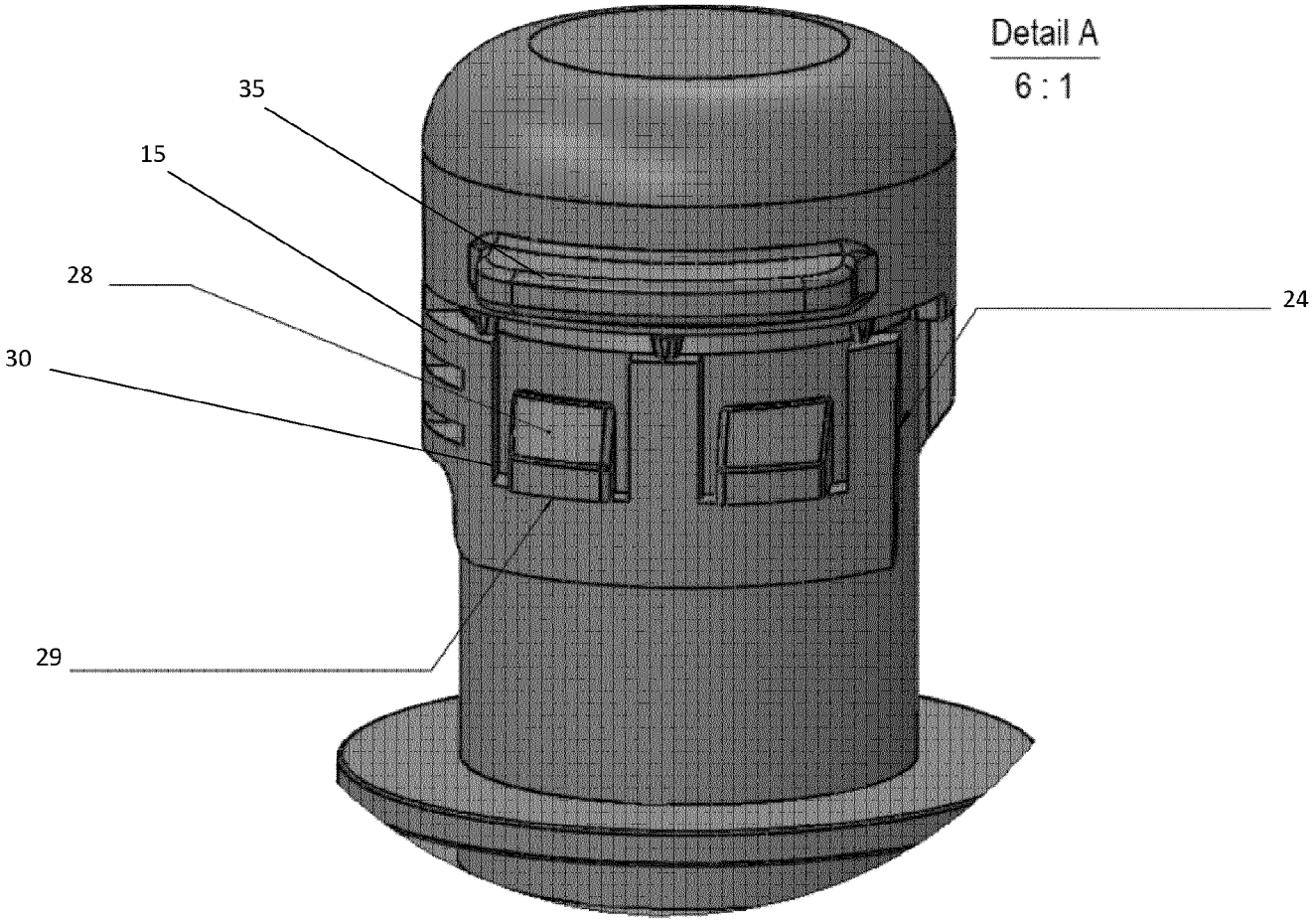

FIGS. 3 and 6 show the fitment in an as-moulded condition. The cap is in an open position. The member is connected to the cap by frangible bridges 26.

FIGS. 1, 4, 7 and 8 show the cap initially closed onto the base. The spout 20 includes hooks 27 (two, in this embodiment) each having inclined upper surfaces 28 and flat abutment surfaces 29. When the cap is closed for the first time the member can pass over the surfaces 28 so that the hooks engage in slots/cut-outs 30 formed in the member.

Before the first opening, therefore, the hooks 27 on the spout 20 engage in the slots 30 in the member 24 to maintain the cap closed in position with the tamper-evident band and the bridges 26 not broken.

Figure 1:
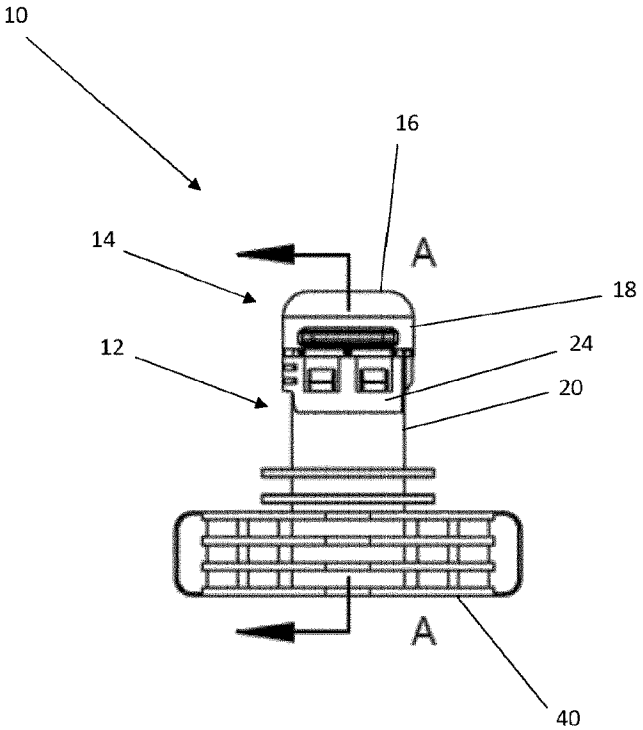
Figure 1:
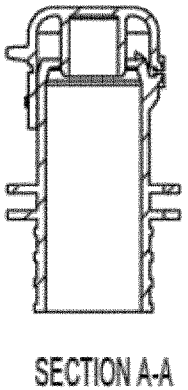

When the contents of the pouch are required the closure cap needs to be lifted. The cap cannot be lifted because the member cannot pass over the hooks (FIG. 1, 4, 7, 8). The band is held by the hooks when the cap/lid is closed.

Figure 9:
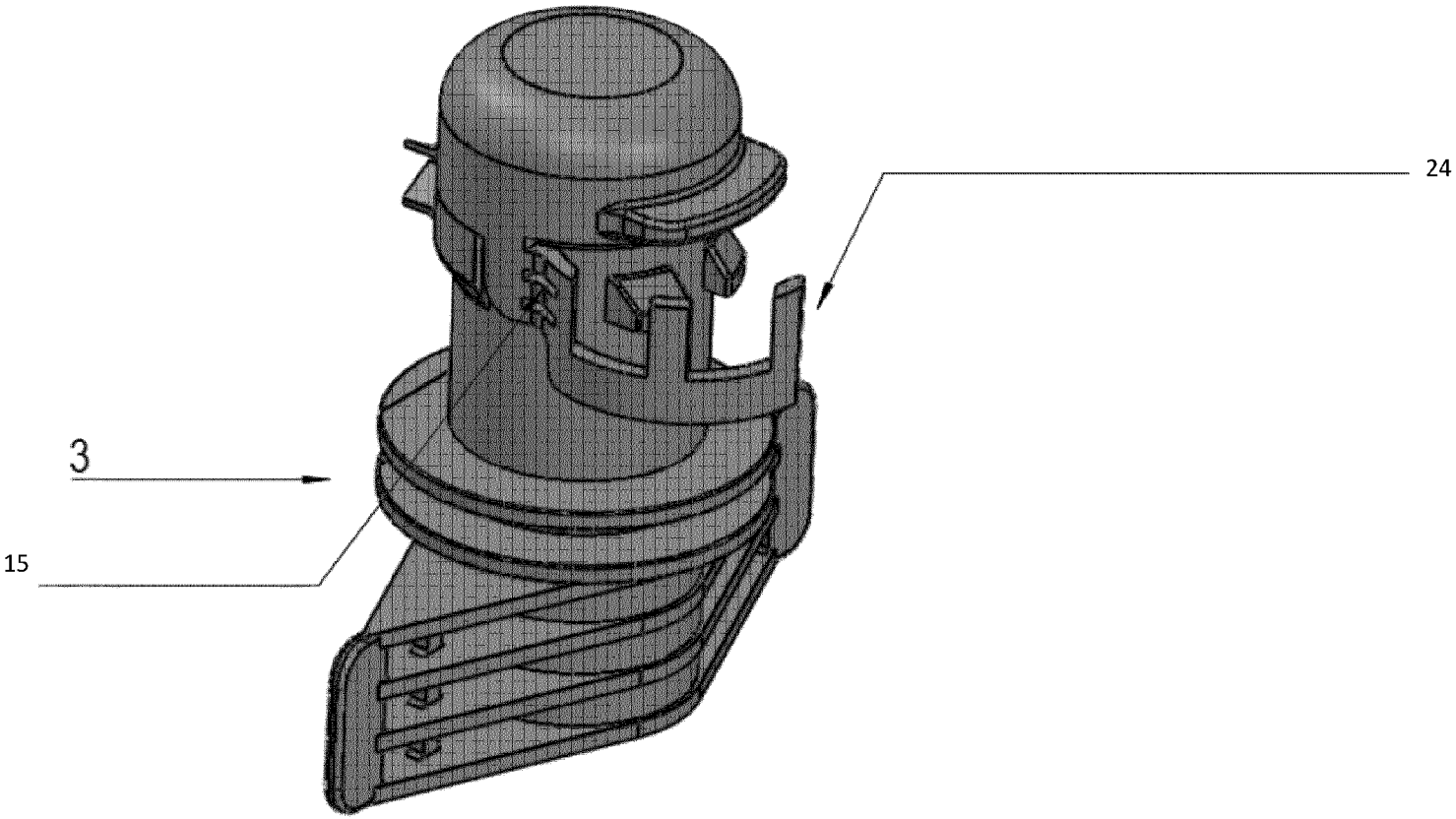

To be able to open the cap the member must first be hinged/rotated/torn away as shown in FIG. 9. This movement breaks the bridges 26. The tamper-evident band remains attached to the cap.

Figure 10:
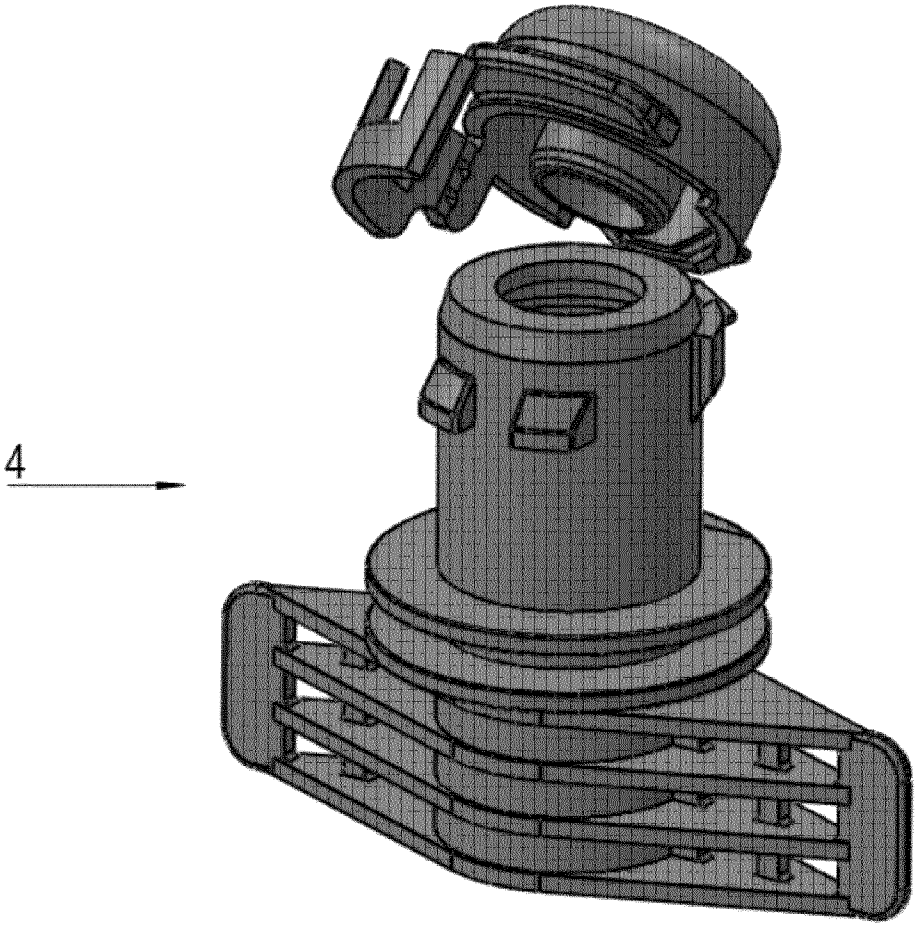
Figure 11:
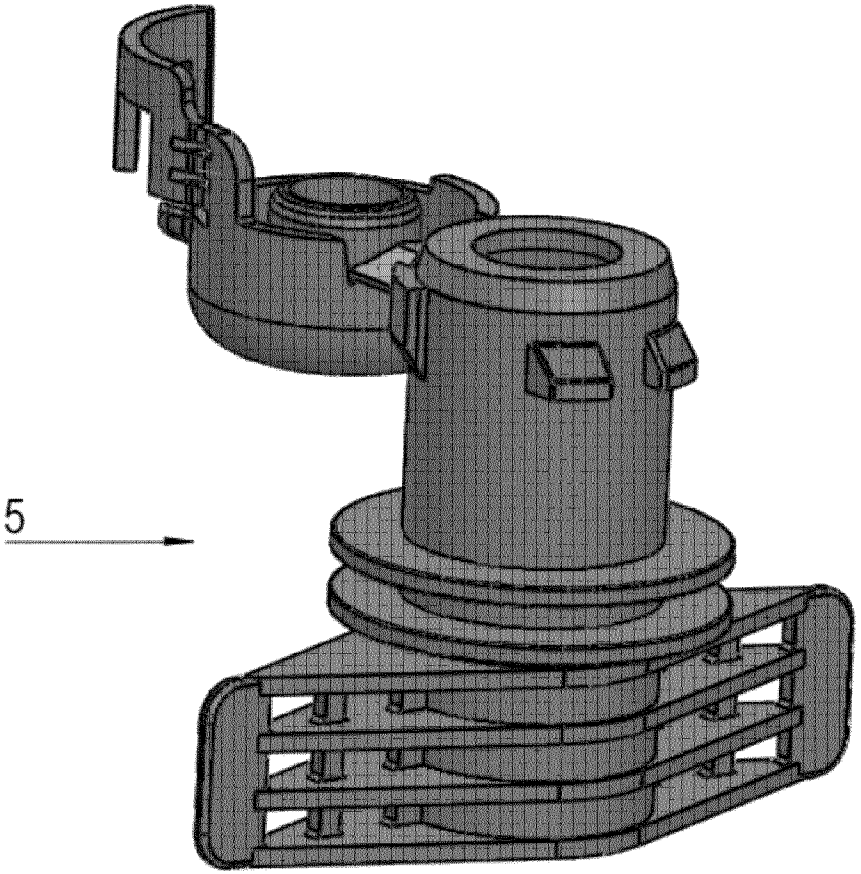
Figure 12:
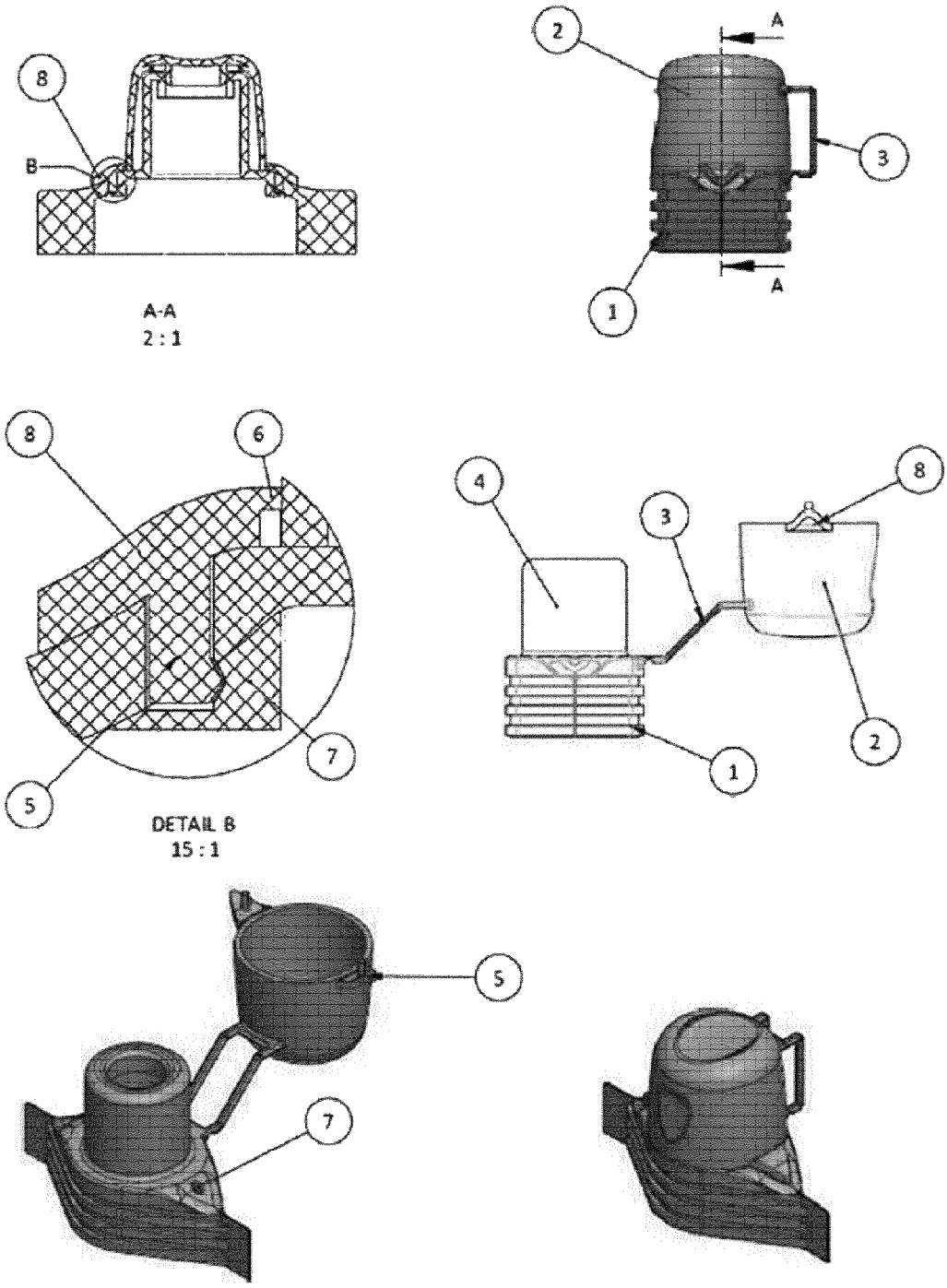
Figure 13:
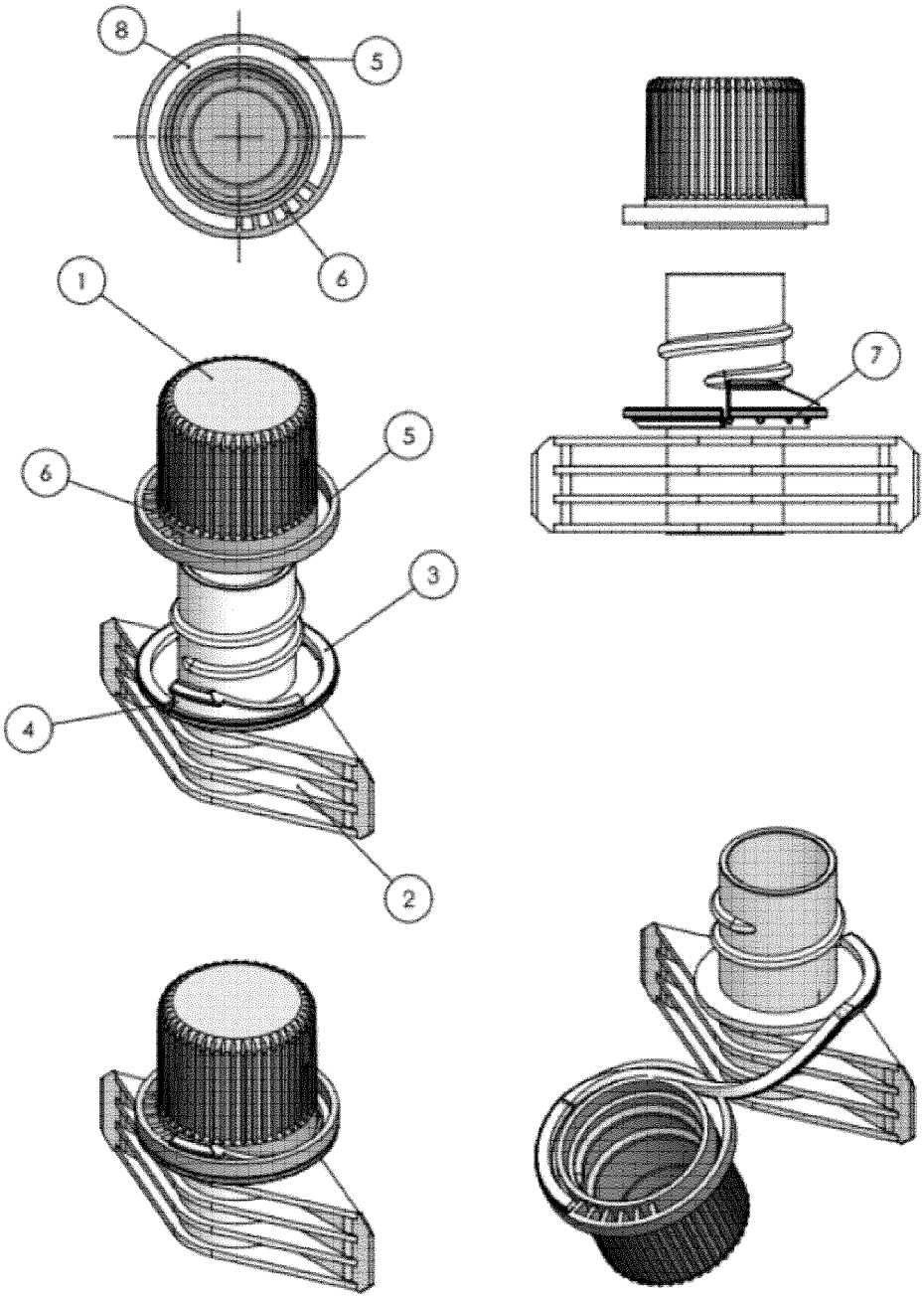
Figure 14:
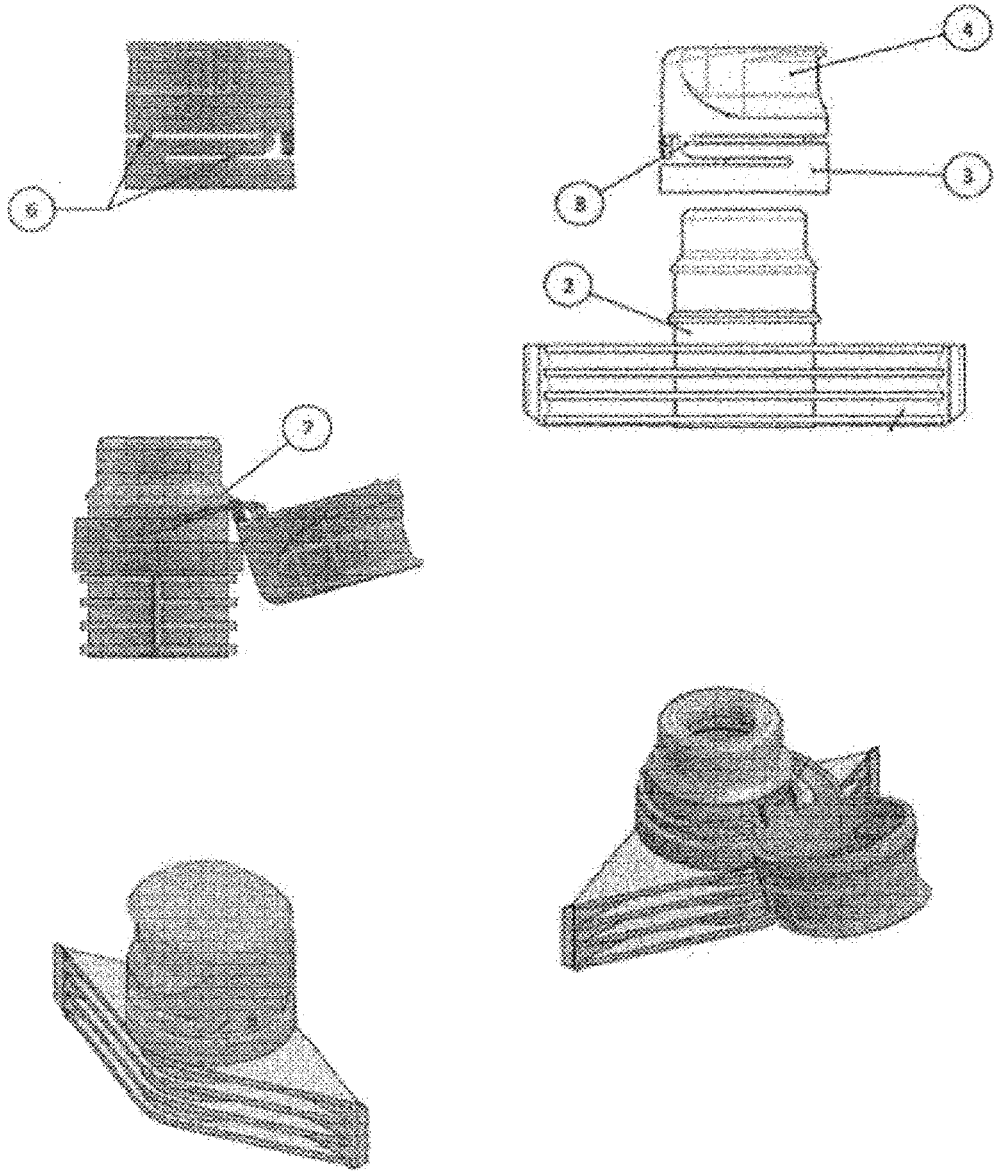
Figure 15:
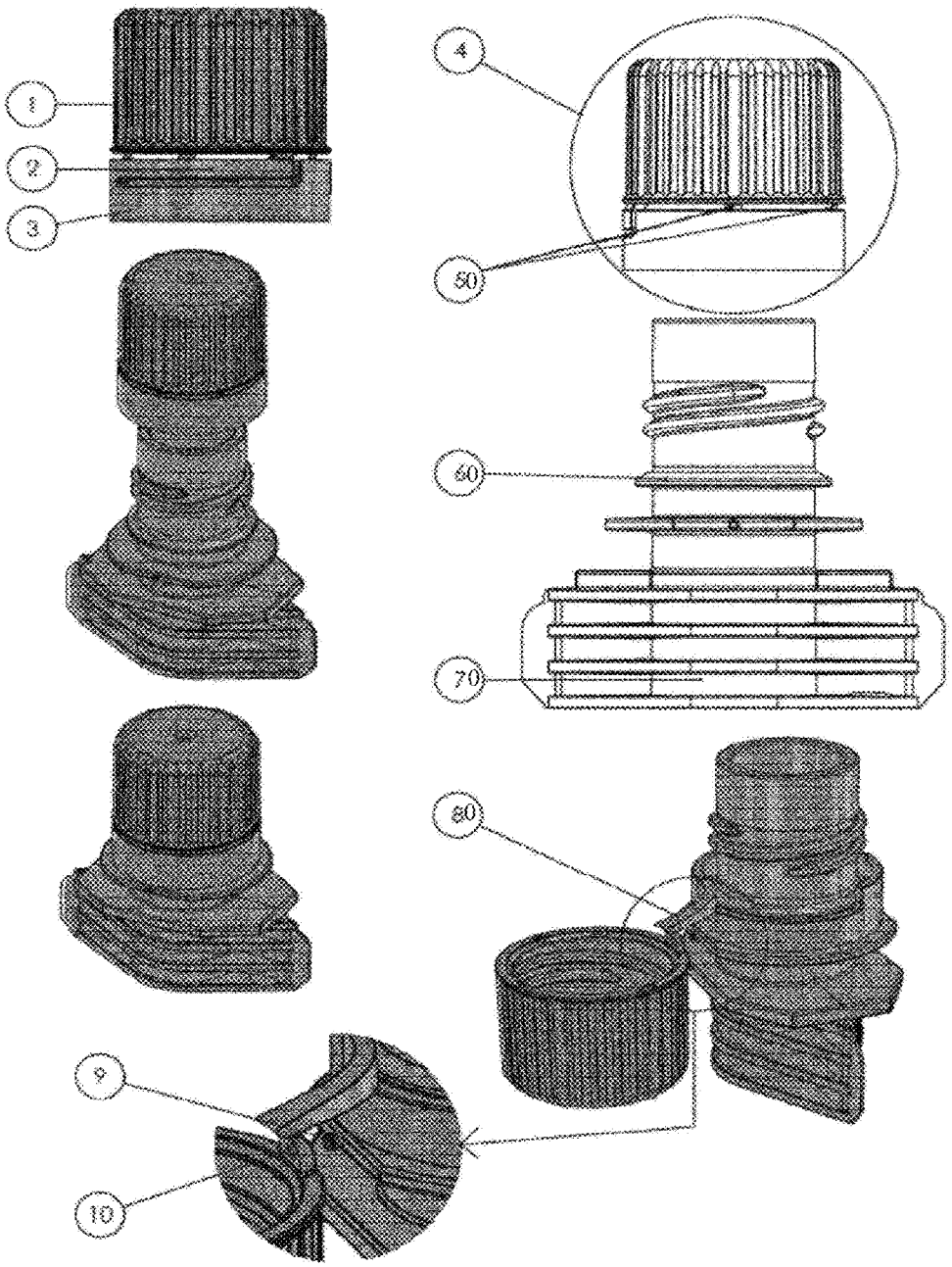

The cap is provided with a peak 35 to assist lifting. FIG. 10 shows the cap half open and FIG. 11 shows the cap fully open.

The closure can be replaced to seal any remaining contents of the pouch if required. The member 24 may be folded back so that the hooks engage in the U-shape slots (but the bridges will remain broken, of course).

FIG. 12

In the context of a tamper-evident single component for flexible pouch which should remain linked to the base after opening; proposal of an innovative solution liaison.

The concept uses a hinge 3 between a cover 2 and a base 1.

Proposed Solution:

Tamper-proofness consists of at least one detachable element 8 with clip 5 linked to the cover 2 by bridges 6.

When closing the cover 2 detachable element with clip 5 snaps into the housing 7 of the base to create inviolability.

The cover 2 is snapped onto the rim 4.

When the hood 2 is opened by the consumer there is a rupture of the bridges 6 which creates an opening indicator and the detachable element remains fixed to the base 1.

The tilting of the cover 2 around the hinge area 3, this fact at the time of opening and frees the drinker.

The cover 2 is still attached to the base 1 after opening by means of the hinge.

During the reclosing of the hood 1 the hinge 3 will resume its initial place allowing the snap-fitting of the hood 1 on the drink 4 and thus guarantee the tightness.

Concept Improvement:

This solution consists of a single component, therefore it is manufactured with a single material. If the pouch is made from the same material as the one-component, there is a 100% recyclable system).

In another design the clip can be on the tie-back and the housing is located in the detachable element of the cover

FIG. 13

As part of a tamper-evident cap for flexible pouch which should remain attached to the pouch after opening; proposal of an innovative connection solution.

The concept uses a strap 3 between a cap 1 and a base 2.

When the strap 3 belongs to the cap 1, the base 2 being welded to the pouch, the deformation of the strap 3 during unscrewing and re-screwing is complicated: crushing or twisting of the strap hampering use.

Proposed Solution:

On this model the strap 3 belongs to the base 2.

When the cap 1 is screwed onto the base 2 a belt 5 of the cap 1 snaps into the clip 4 of the strap 3.

The clip 4 is free in the clearance 8 of the belt 5, which allows the rotation of the cap 1 for complete screwing.

When the cap 1 is unscrewed, the connection 6, between the belt 5 and the cap 1, comes to jam against the clip 4.

By continuing to divide the strap 3 takes place, the bridges 7 break, which creates an opening indicator; but the cap 1 remains attached to the base 2.

By removing the cap 1 to release the rim, the strap deforms but the plug 1 is still held by the clip 4 therefore the cap 1 remains attached to the strap 3.

When the strap 3 is screwed back on, it will return to its original position, allowing the cap 1 to be screwed back onto the base 2.

FIG. 14

As part of a tamper-evident cap for flexible pouch which should remain attached to the base after opening; proposal of an innovative connection solution.

The concept uses a hinge 8 between the cap 1 and the tamper-evident belt 3.

Proposed Solution:

The cap 1 is snapped at the level of the inviolability band, on the base 2.

When the cap 1 is opened, the bridges 6 break, which creates an opening indicator. The tilting of the plug around the hinge 8 causes the bridges 7 to extend, which allows the cap 1 to be released beyond the rim. This movement can be facilitated by the presence of a rigid element and protruding from the main body, a tongue, which, bearing on the base 2, serves as a point of rotation.

The tab remaining in contact with the neck 2 of the base 1 allows the plug 4 to be kept in the open position.

The cap 1 being connected by strands 7 to the tamper-evident belt in the open position, the cap 1 is always attached to the base 2 after opening.

When closing, the strands 7 will resume their initial places allowing the closure and snap-on of the cap 1 on the base 2.

FIG. 15

As part of a tamper-evident cap for a flexible bag which should remain attached to the base after opening; proposal of an innovative linking solution.

Proposed Solution:

Strand 80 connects cap 1 to the strip inviolability, this strand 80 is completely part of the design of the cap 1.

The concept is to have a base 70, a stopper body and its tamper-evident band 3 as a basic element common to different versions.

When screwing the cap 1 on the base 70, the tamper-evident band 3 snaps onto the counter ring 60 of the base 70, the tamper-evident band 3 remains free to rotate.

When the cap 1 is unscrewed, the bridges 50 break, which creates an opening indicator.

By moving the cap 1 aside to release the drink, the strand 80 is deformed but the cap 1 is still attached to the tamper-evident band 3.

When screwing in, the tamper-evident strip 3 and the strand 80 rotate with the cap 1.

Option to block cover 1 in the open position on the base 70. The lug 9 of the base 70 allows the hole 10 created on the strand 80 to snap onto it.

Although illustrative embodiments of the invention have been disclosed in detail herein, with reference to the accompanying drawings, it is understood that the invention is not limited to the precise embodiments shown and that various changes and modifications can be effected therein by one skilled in the art without departing from the scope of the invention.

The invention claimed is:

1. A pouch fitment comprising:

a base which is attachable to a pouch and includes a dispensing spout, the pouch fitment further comprises a closure cap for closing the dispensing spout, in which the closure cap is non-releasably associated with the base, the base and the closure cap are connected by a hinge, the pouch fitment comprises a non-detachable tamper-evident member, the non-detachable tamper-evident member is movable from an engaged position to a released position, in the engaged position the closure cap cannot be opened and in the released position the closure cap can be opened, a hinge function is provided between the closure cap and the non-detachable tamper-evident member, the non-detachable tamper-evident member is connected to the closure cap by frangible bridges, to be able to open the cap the non-detachable tamper-evident member must first be hinged away and this movement breaks the frangible bridges and the non-detachable tamper-evident member remains attached to the closure cap.

2. The pouch fitment of in claim 1, in which the non-detachable tamper-evident member is a band.

3. The pouch fitment of claim 1, in which the dispensing spout includes hooks and the non-detachable tamper-evident member includes slots or cut-outs in which the hooks engage.

4. The pouch fitment of claim 3, in which the hooks have an inclined upper surface and a flat abutment surface.

5. The pouch fitment of claim 1, in which the closure cap is provided with a peak to assist lifting.

6. The pouch fitment of claim 1, in which the base comprises a sealing part and the sealing part comprises lateral tabs joined by fins.

7. The pouch fitment of claim 6, in which axial strengthening members extend between the fins.

8. The pouch fitment of claim 1, in which the closure cap comprises a top plate with a side wall depending from the periphery thereof.

9. The pouch fitment of claim 1, wherein the pouch fitment is formed from a material and a pouch configured to receive the pouch fitment is formed from the same material.

10. The pouch fitment of claim 1, wherein the pouch fitment is formed as a unitary component.

11. A pouch fitment comprising:

a base and a closure cap, the base and the cap are connected by a hinge, the closure cap comprises a circular top plate with a side wall depending from the periphery thereof, the base comprises a spout and a sealing part, the sealing part comprises two lateral/axial tabs joined by four horizontal fins, axial strengthening members extend between the fins, a frontal tamper-evident member is molded with the cap, a hinge function/mechanism is provided between the closure cap and the frontal tamper-evident member, the frontal tamper-evident member is connected to the cap by frangible bridges, the link between the closure cap and the frontal tamper-evident member is not breakable, only the frangible bridges need to be broken to allow the closure cap to be opened, the spout includes hooks each having inclined upper surfaces and flat abutment surfaces, when the cap is closed for the first time the frontal tamper-evident member can pass over the surfaces so that the hooks engage in slots/cut-outs formed in the frontal tamper-evident member, before the first opening, therefore, the hooks on the spout engage in the slots in the frontal tamper-evident member to maintain the closure cap closed in position with the frontal tamper-evident band and the bridges not broken, when the contents of the pouch are required the closure cap needs to be lifted, the closure cap cannot be lifted because the frontal tamper-evident member cannot pass over the hooks, the frontal tamper-evident member is held by the hooks when the closure cap is closed, to be able to open the closure cap the frontal tamper-evident member must first be hinged/rotated/torn away, this movement breaks the bridges, the frontal tamper-evident member remains attached to the closure cap, the closure cap is provided with a peak to assist lifting.

12. A pouch fitment comprising:

a base adapted to be attached to a pouch and including a dispensing spout, a closure cap for closing the dispensing spout, a first hinge coupled between the base and the closure cap to allow movement of the closure cap relative to the base between a closed position closing the dispensing spout and an opened position exposing the dispensing spout, and a non-detachable tamper-evident member, the non-detachable tamper-evident member including frangible bridges coupled to the base and a second hinge coupled to the closure cap, wherein the non-detachable tamper-evident member is movable about the second hinge from an engaged position, in which the non-detachable tamper-evident member blocks movement of the closure cap to the opened position, to a released position, in which the frangible bridges are separated from the base while the closure cap is in the closed position and non-detachable tamper-evident member remains attached to the closure cap to free the closure cap for movement from the closed position to the opened position.

13. The pouch fitment of claim 12, wherein the closure cap is configured to pivot about a first axis established by the first hinge and the non-detachable tamper-evident band is configured to pivot about a second axis established by the second axis, the second axis being non-parallel to the first axis.

14. The pouch fitment of claim 13, wherein the second axis is perpendicular to the first axis.

15. The pouch fitment of claim 12, wherein a distal end of the non-detachable tamper-evident band is spaced a first distance from the base in the engaged position and a second distance, greater than the first distance, in the released position when the closure cap is in the closed position.

* * * * *